United States Patent [19]

Murata et al.

[11] Patent Number: 5,029,361

[45] Date of Patent: Jul. 9, 1991

[54] FLOOR NOZZLE FOR VACUUM CLEANER

[75] Inventors: Yoshitaka Murata, Shiga; Hiroshi Kawakami; Tsuyoshi Tokuda, both of Youkaichi, all of Japan

[73] Assignee: Matsushita Electric Industrial Co., Ltd., Osaka, Japan

[21] Appl. No.: 260,742

[22] Filed: Oct. 21, 1988

[30] Foreign Application Priority Data

| | | | |
|---|---|---|---|
| Oct. 23, 1987 | [JP] | Japan | 62-268663 |
| Apr. 8, 1988 | [JP] | Japan | 63-87476 |
| Apr. 12, 1988 | [JP] | Japan | 63-89845 |
| May 23, 1988 | [JP] | Japan | 63-125323 |
| May 23, 1988 | [JP] | Japan | 63-125324 |
| May 23, 1988 | [JP] | Japan | 63-125325 |
| May 23, 1988 | [JP] | Japan | 63-125326 |

[51] Int. Cl.[5] ..... A47L 5/26

[52] U.S. Cl. ..... 15/383; 15/41.1; 15/141.2; 15/230.16; 15/366

[58] Field of Search ..... 15/383–392, 15/111–113, 141.1, 141.2, 179, 182, 183, 215–217, 237–240, 236.05–236.10, 256.5, 256.52, 159 A, 41.1, 366, 230.16; 26/22, 23–25, 26

[56] References Cited

U.S. PATENT DOCUMENTS

| | | | |
|---|---|---|---|
| 1,265,790 | 5/1918 | Kirby | 15/387 |
| 2,271,551 | 2/1942 | Hoover | 15/182 |
| 2,484,235 | 10/1949 | Mead | 15/179 |
| 2,571,042 | 10/1951 | Kemp | 15/236.1 |
| 2,607,064 | 8/1952 | Sullivan et al. | 15/159 A |
| 3,716,889 | 2/1973 | Goldstein | 15/383 |
| 3,872,539 | 3/1975 | Doyel | 15/392 |
| 4,042,995 | 8/1977 | Varon | 15/159 A |
| 4,285,737 | 8/1981 | Price | 15/159 A |
| 4,403,372 | 9/1983 | Keane et al. | 15/391 |
| 4,480,350 | 11/1984 | White | 15/159 A |
| 4,586,211 | 5/1986 | Phillips | 15/179 |
| 4,646,380 | 3/1987 | Kobayashi et al. | 15/179 |
| 4,845,797 | 7/1989 | Kobayashi | 15/179 |

FOREIGN PATENT DOCUMENTS

| | | | |
|---|---|---|---|
| 0084345 | 7/1983 | European Pat. Off. . | |
| 1440453 | 7/1965 | France | 15/182 |
| 642819 | 9/1950 | United Kingdom . | |
| 685208 | 12/1952 | United Kingdom . | |

*Primary Examiner*—Harvey C. Hornsby
*Assistant Examiner*—Mark Spisich
*Attorney, Agent, or Firm*—Pollock, VandeSande & Priddy

[57] ABSTRACT

A floor nozzle for use with a vacuum cleaner has an agitator rotatably disposed in a housing and includes a rotor and at least one elongate web mounted on a circumferential surface of the rotor. The elongate web is made of a flexible material and has a plurality of teeth on at least one of opposite surfaces thereof. The elongate web has a T-shaped helical anchor foot inserted in a complementary T-shaped helical groove defined in the circumferential surface of the rotor. The floor nozzle also has a turbine rotatable under a vacuum developed by the vacuum cleaner and operatively coupled to the agitator for rotating the agitator.

1 Claim, 8 Drawing Sheets

FLOOR NOZZLE FOR VACUUM CLEANER

BACKGROUND OF THE INVENTION

The present invention relates to a floor nozzle having an agitator for use with a vacuum cleaner.

Floor nozzles for use with vacuum cleaners have an agitator comprising a rotor with bristles attached to its circumferential surface. When cleaning a floor such as a carpeted floor, the bristles on the rotating rotor rub the carpet to brush up dust particles which are then drawn into the floor nozzle under a vacuum developed by the vacuum cleaner.

One major problem with the conventional agitators is that waste pieces of thread and other filamentary objects tend to get entangled with the bristles. Frequently, the entire surface of the agitator is covered with such unwanted fibrous matters to the point where the desired function of the agitator can no longer be performed. Removal of the entangled thread pieces is tedious and time-consuming.

SUMMARY OF THE INVENTION

In view of the aforesaid shortcomings of the conventional vacuum cleaner floor nozzles, it is an object of the present invention to provide a floor nozzle for use with a vacuum cleaner which can prevent filamentary pieces or waste threads from being entangled with an agitator to allow the agitator to perform its desired function at all times.

According to the present invention, a floor nozzle for use with a vacuum cleaner includes a housing, an agitator rotatably disposed in the housing, the agitator comprising a rotor and at least one elongate web mounted on a circumferential surface of the rotor, the elongate web being made of a flexible material and having a plurality of teeth on at least one of opposite surfaces thereof, and means disposed in the housing for rotating the agitator.

The elongate web has smooth slanted surfaces respectively on opposite ends thereof to prevent the opposite ends of the web from catching filamentary dust pieces such as hairs and waste threads.

The rotor has at least one helical groove of a substantially T-shaped cross section defined longitudinally in the circumferential surface, the elongate web having on one edge thereof an anchor foot of a substantially T-shaped cross section, the anchor foot being inserted in the groove and having a plurality of longitudinally extending ridges held against an inner surface of the groove. Since the anchor foot is held against the inner surface of the groove only through the ridges providing a small area of contact, the flexible web can smoothly be inserted longitudinally into the groove from one open end thereof without being subjected to large frictional resistance and unwanted deformation. Therefore, the agitator can be assembled with ease and is of high quality.

The rotor is extrusion-molded of a material of a low expansion ratio such as polystyrene. The rotor thus formed has a hard skin layer on its outer surface (including the inner surface of the T-shaped groove) for reducing frictional resistance which is presented to the insertion of the elongate web into the groove.

Moreover, the elongate web includes a first portion having the teeth and second portion free of the teeth and near the rotor, the first portion having a thickness different from that of the second portion. The teeth include a first group of teeth and a second group of teeth, the teeth of the first group and the teeth of the second group having different heights and being alternately positioned. The teeth may be disposed on opposite surfaces of the elongate web including a plurality of first teeth on one of the opposite surfaces thereof and a plurality of second teeth on the other opposite surfaces. With this arrangement, the floor nozzle can effectively collect hairs, waste threads, and other filamentary dust pieces from a floor nozzle being cleaned, and can maintain a desired high dust-collecting capability. The agitator also has a long service life.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
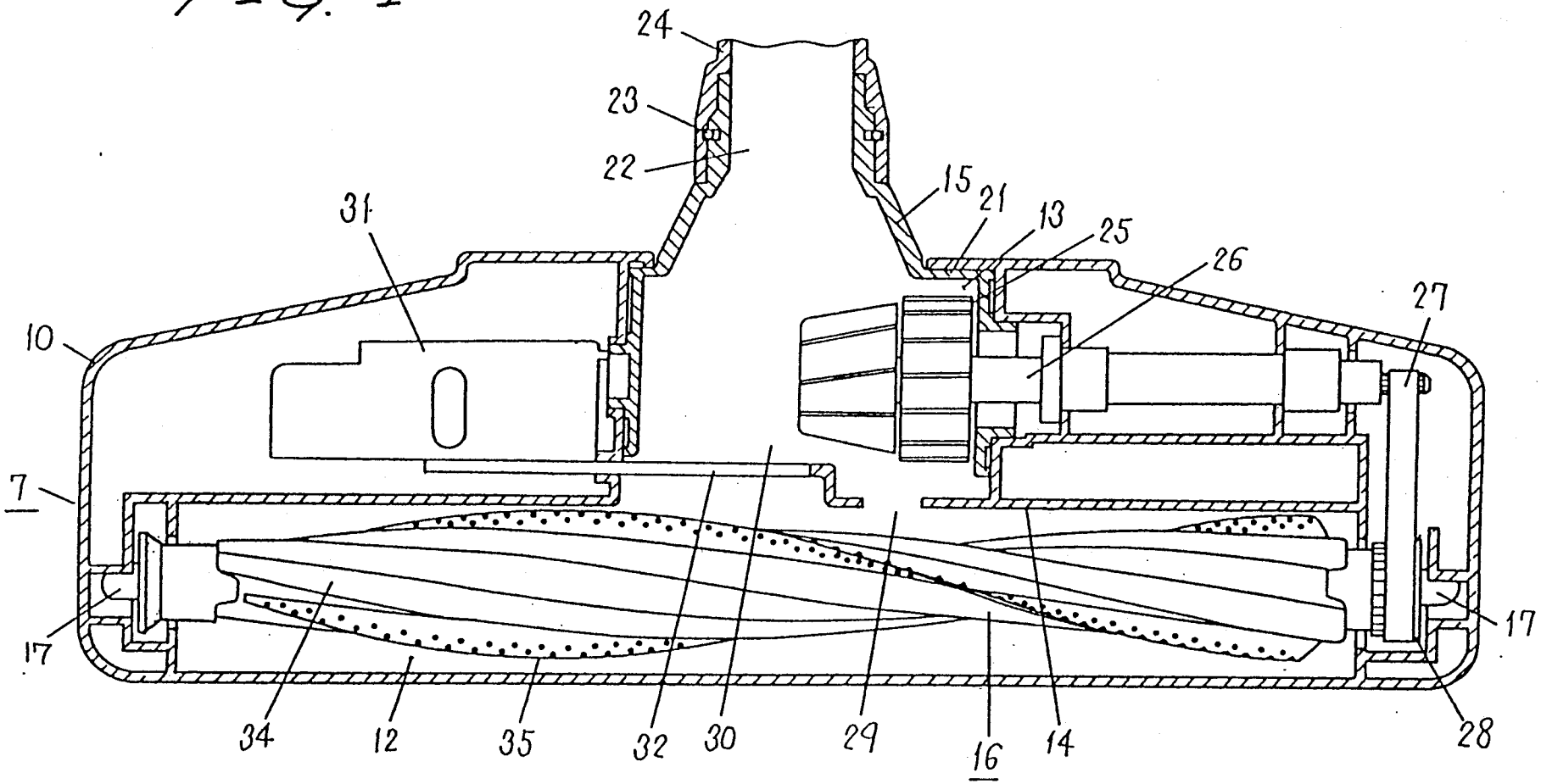
FIG. 1 is a sectional plan view of a floor nozzle according to an embodiment of the present invention, with an upper casing omitted from illustration.
Figure 2:
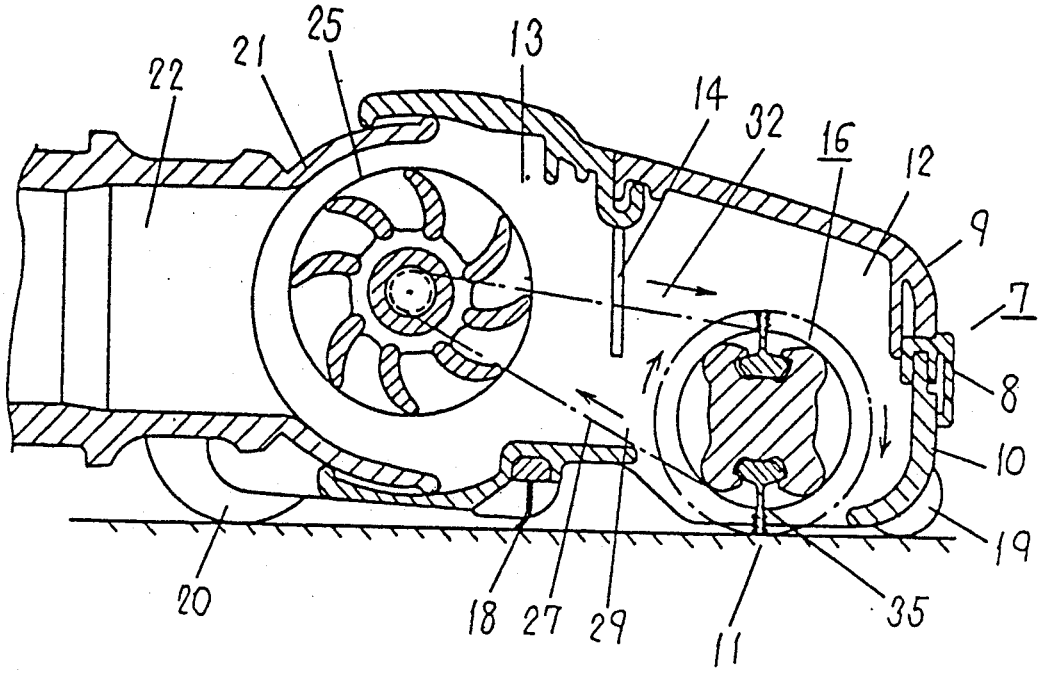
FIG. 2 is a vertical cross-sectional view of the floor nozzle.

FIGS. 1 through 7 show a floor nozzle for use with a vacuum cleaner according to an embodiment of the present invention. As shown in FIGS. 1 and 2, the floor nozzle has a housing 7 comprising upper and lower casings 9, 10 joined to each other. The housing 7 has a suction chamber 12 defined in a front portion thereof and having a lower suction opening or port 11, and a turbine chamber 13 defined in a rear portion thereof. The turbine chamber 13 is separated from the suction chamber 12 by a partition 14. The housing 7 accommodates therein an agitator 16 disposed in and parallel to the suction chamber 12 for rotation about its own horizontal axis. The agitator 16 is rotatably supported by a pair of opposite bearings 17 on laterally opposite side walls of the suction chamber 12. A fixed brush 18 is securely attached to the lower panel of the housing 7 behind the suction port 11 and extends parallel to the suction port 11. Wheels 19, 20 are rotatably mounted on the housing 7 at front and rear portions thereof for keeping the suction port 11 spaced a certain distance from a surface to be cleaned.

A substantially semicylindrical suction joint 21 is angularly slidably supported in a rear portion of the turbine chamber 13 by a pair of laterally opposite shafts, the suction joint 21 having a rearwardly projecting mouth 15 from which a joint tube 22 extends rearwardly. A floor nozzle pipe 24 is rotatably mounted on the joint tube 22 with an O-ring 23 interposed therebetween. The floor nozzle pipe 24 is detachably connected to an extension pipe (not shown) which is coupled through a hose to the suction hole of a vacuum cleaner (not shown).

A turbine 25 is rotatably disposed in the turbine chamber 13 with its outer circumference partly surrounded by the suction joint 21. The turbine 25 has an integral shaft 26 projecting laterally out of the turbine chamber coaxially through one of the shafts of the suction joint 21.

The shaft 26 is rotatably supported in the nozzle housing 10 and has its projecting distal end operatively coupled to a pulley 28 on one end of the agitator 16 by means of an endless belt 27 near one of the bearings 17. Therefore, the agitator 16 can be rotated about its own axis by rotative power transmitted from the turbine 25 through the belt 27.

The turbine 25 is displaced off the center of the turbine chamber 13 as it is viewed in plan toward the belt 27. The partition 14 has two vent holes 29, 30 defined therein. The vent hole 29 is positioned in confronting relation to the lower half of the turbine 25. The other vent hole 30 is positioned in directly confronting relation to the joint tube 22 of the suction joint 21, without facing the turbine 25. A switching lever 31 slidably mounted in the nozzle housing 10 has a shield plate 32 which can be laterally moved to selectively open and close the vent hole 30 in response to sliding movement of the switching lever 31.

When the switching lever 31 is slid to the right in FIG. 1 to cause the shield plate 32 to close the vent hole 30 and open the vent hole 29 only, as shown, air drawn from the suction port 11 to the suction chamber 12 to the vent hole 29 impinges upon the turbine 25, and then flows from the joint tube 22 to the nozzle pipe 24 to the extension pipe to the hose and then to the vacuum cleaner. The turbine 25 is therefore forced to rotate by the air flowing therepast, whereupon the agitator 16 is also rotated by the belt 27.

Figure 3:
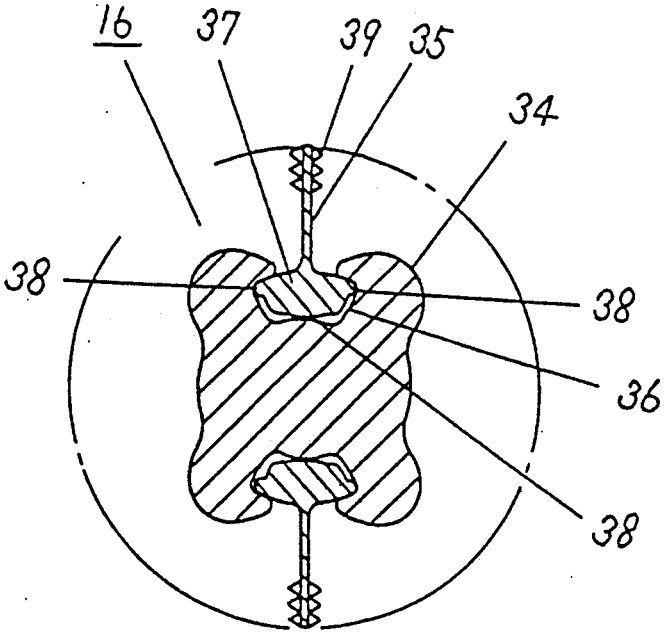
FIG. 3 is a transverse cross-sectional view of an agitator.
Figure 4:
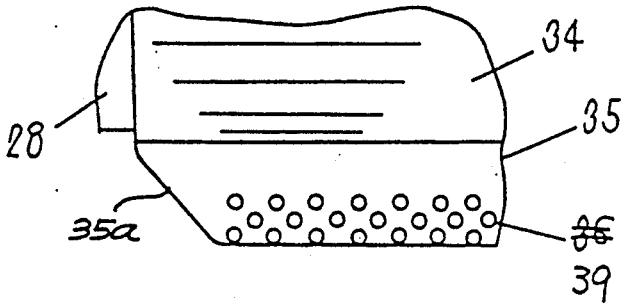
FIG. 4 is a fragmentary front elevational view showing the shape of an end of an elongate web.
Figure 5:
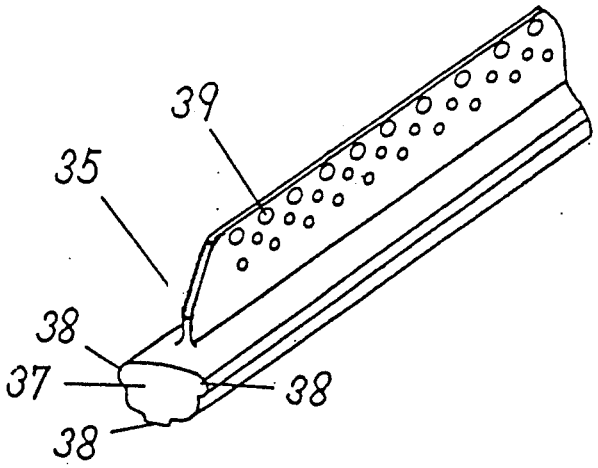
FIG. 5 is a fragmentary perspective view of the elongate web.
Figure 6:
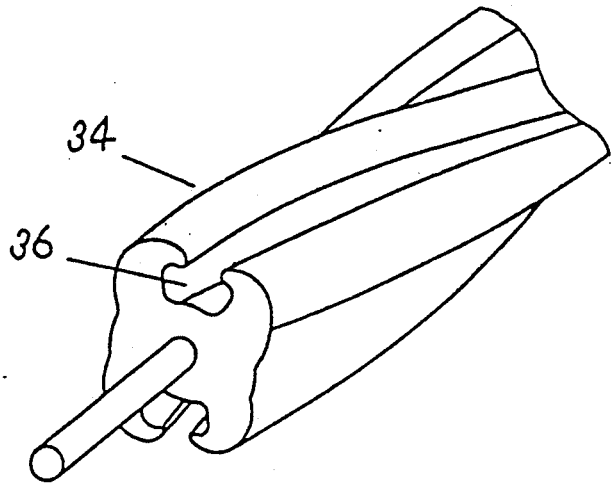
FIG. 6 is a fragmentary perspective view of a rotor.

The agitator 16 comprises an elongate rotor 34 with a pair of diametrically opposite elongate webs 35 mounted on the outer circumferential surface and extending helically in the longitudinal direction of the rotor 34. More specifically, as shown in FIGS. 3 and 6, the rotor 34 has a pair of diametrically opposite helical grooves 36 of substantially T-shaped cross section defined in the outer circumferential surface, each groove 36 having open opposite ends. The elongate webs 35 have respective anchor feet 37 of substantially T-shaped cross section on one edge thereof which are snugly fitted respectively in the grooves 36. As shown in FIGS. 3 and 5, each of the anchor feet 37 has a plurality of longitudinally continuous ridges 38 held in contact with the inner surface of one of the grooves 36. The elongate webs 35 are made of a flexible material such as rubber or the like, and have a multiplicity of teeth 39 on at least one surface thereof (which will be a leading surface when the rotor 34 is rotated). As illustrated in FIG. 4, each of the opposite ends of each elongate web 35 has a smooth tapered or slanted surface 35*a*.

Figure 7:
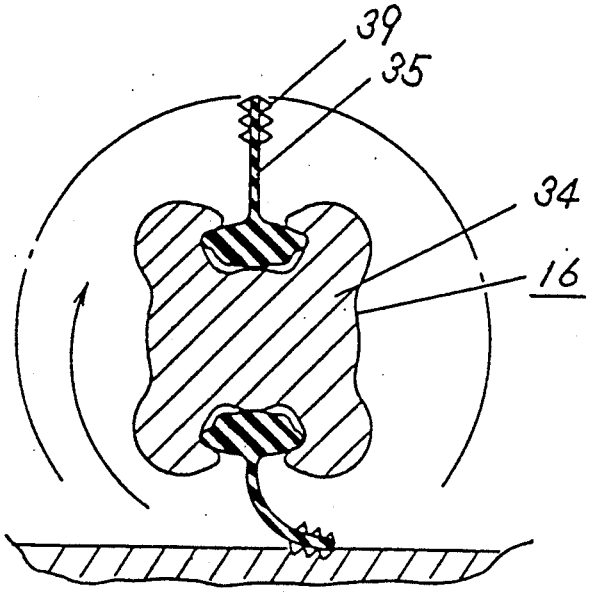
FIG. 7 is a transverse cross-sectional view explaining operation of the agitator.

When the agitator 16 is rotated clockwise about its own axis as shown in FIG. 7, the elongate webs 35 (one at a time) is flexibly displaced relatively counterclockwise by rubbing contact with a floor surface to be cleaned, so as to lie along the floor surface. Thereafter, the web 35 is moved relative to the floor surface while rubbing the same, whereupon the teeth 39 brush up dust particles from the floor surface. The dust particles separated from the floor surface are then effectively drawn into the nozzle housing 7 under a vacuum from the vacuum cleaner and by radially recovering action of the web 35 due to both the resiliency thereof and centrifugal forces acting thereon. When the elongate web 35 is held in contact with the floor surface, it shuts off air streams coming from the front side of the floor nozzle, so that the vacuum from the vacuum cleaner acts intensively and effectively on the floor surface being cleaned.

Since the elongate webs 35 are in the form of elongate unitary strips rather than bristles, waste pieces of thread and other filamentary objects are prevented from getting entangled with the webs 35. The tapered or slanted surfaces 35*a* of the ends of the webs 35 prevent the web ends from being excessively flexed, i.e., allow them to become somewhat resilient, so that fibrous objects will not remain entangled with the ends of the webs 35 or will not easily be caught by the ends of the webs 35.

The elongate webs 35 are inserted into the rotor 34 as follows: the T-shaped anchor foot 37 of each of the elongate webs 35 is longitudinally inserted into one of the T-shaped grooves 36 from one of the open ends thereof. As the anchor foot 37 is progressively inserted into the corresponding groove 36, only the ridge 38 are held against the inner surface of the groove 36. Therefore, any frictional resistance to the sliding movement of the anchor foot 37 is reduced. The webs 35 which are made of a flexible material, elongate, and stretchable can smoothly be inserted into the respective helical grooves 36 while retaining their original shape. Accordingly, the elongate webs 35 can be installed in place in a reduced number of assembling steps and are stable in quality.

In the above embodiment, the agitator 16 is driven by the turbine 25. However, a motor may be employed to rotate the agitator 16. Each of the elongate webs 35 may be provided with teeth 39 on its opposite surfaces so that the web 35 will be bidirectional when assembled, i.e., can be assembled without concern over its direction.

Figure 8:
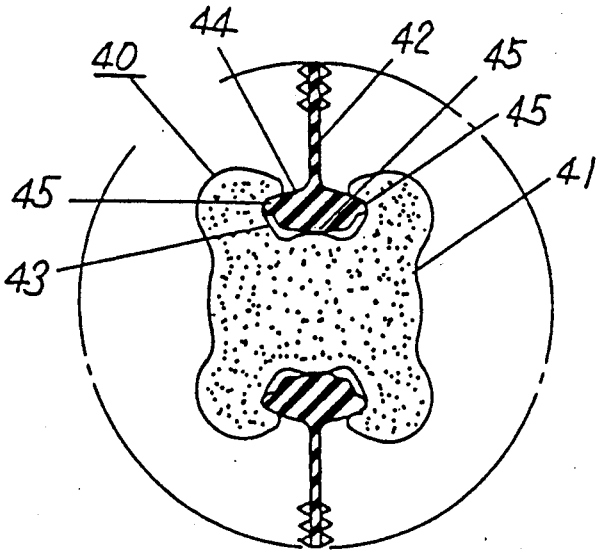
FIG. 8 is a transverse cross-sectional view of an agitator according to another embodiment of the present invention.

FIG. 8 shows an agitator according to another embodiment of the present invention. The agitator, generally indicated by 40, has a pair of helical elongate webs 42 mounted on the outer circumferential surface of a rotor 41 in diametrically opposite relation and extending in the longitudinal direction of the rotor 41. The rotor 41 has a pair of T-shaped helical grooves 43 defined in the outer circumferential surface thereof in diametrically opposite relation. The rotor 41 is extrusion-molded in a helical shape of a material of low expansion ratio such as polystyrene. Each of the elongate webs 42 has a T-shaped anchor foot 44 on one edge thereof which is fitted in one of the T-shaped grooves 43. The anchor foot 44 has a plurality of ridges 45 extending continuously in the longitudinal direction and held in contact with the inner surface of the groove 43. The elongate webs 42 are made of a flexible material such as rubber or the like.

Since the rotor 41 is formed by low-ratio expansion extrusion molding, the surface thereof including the inner surface of the T-shaped grooves 43 produces a hard, slippery skin layer upon contact with ambient air in the extrusion molding process. The skin layer on the surface of the rotor 41 has a low coefficient of friction. This fact, together with the limited contact areas of the T-shaped feet 44 provided by the ridge 45 thereon, allows the T-shaped feet 44 to be smoothly inserted into the respective T-shaped grooves 43. The agitator 40 is lightweight and causes low vibration during rotation since it is of a foamed structure.

Other embodiments of agitators in which elongate webs are shaped to match surfaces to be cleaned, to achieve a longer service life, and to maintain a high dust-collecting capability for a prolonged period of time, will be described below.

Figure 9:
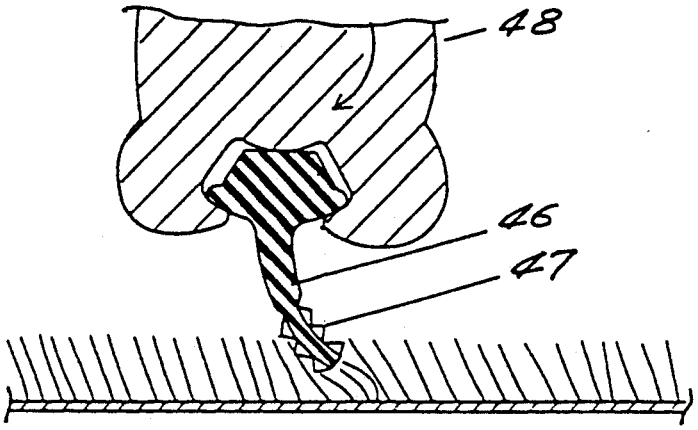
FIG. 9 is a fragmentary transverse cross-sectional view of an agitator according to still another embodiment of the present invention.

FIG. 9 shows an agitator 48 having an elongate web 46 including a portion having teeth 47 which is thinner than the remaining portion of the web 46. When the agitator 48 is rotated clockwise in FIG. 9, the web 46 is flexibly displaced counterclockwise by contact with a floor surface to be cleaned so as to lie along the floor surface. Inasmuch as the tooth-free portion of the web 46 is thicker than the portion having the teeth 47, the web 46 is sufficiently resilient as a whole. The thinner portion of the web 46 which has the teeth 47 is flexible enough to neatly rub the floor surface while following surface irregularities on the floor surface during relative movement o the floor surface. Dust particles are brushed off the floor surface by the teeth 47 of the web 46. The dust particles separated from the floor surface are then effectively drawn into the nozzle housing 7 (FIG. 2) under a vacuum from the vacuum cleaner and by radially recovering action of the web 46 due to both the resiliency thereof and centrifugal forces acting thereon. When the elongate web 46 is held in contact with the floor surface, it shuts off air streams coming from the front side of the floor nozzle, so that the vacuum from the vacuum cleaner acts intensively and effectively on the floor surface being cleaned.

Since the elongate web 46 is in the form of an elongate unitary strip rather than bristles, waste pieces of thread and other filamentary objects are prevented from getting entangled with the web 46.

Figure 10:
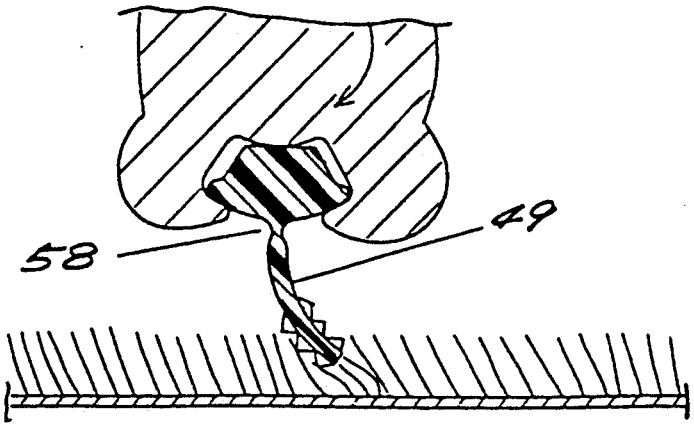
FIG. 10 is a fragmentary transverse cross-sectional view of an agitator according to yet another embodiment of the present invention.

FIG. 10 shows another agitator having an elongate web 49 including a proximal portion 58 that is thinner than the remaining portion of the web 49. Even if the elongate web 49 is made of a material of high surface hardness, the thinner proximal portion 58 allows the web 49 to flex along a floor surface to be cleaned for a high dust-collecting capability. Since the material of the web 49 may be high in surface hardness, it may be an elastomeric material which is highly resistant to wear and highly durable. Where the web 49 is extrusion-molded of a thermoplastic elastomer or the like, it is more moldable to achieve a desired tooth shape, can be produced with better yield, and can be pressed to shape with better productivity if the material has a higher hardness.

Figure 11:
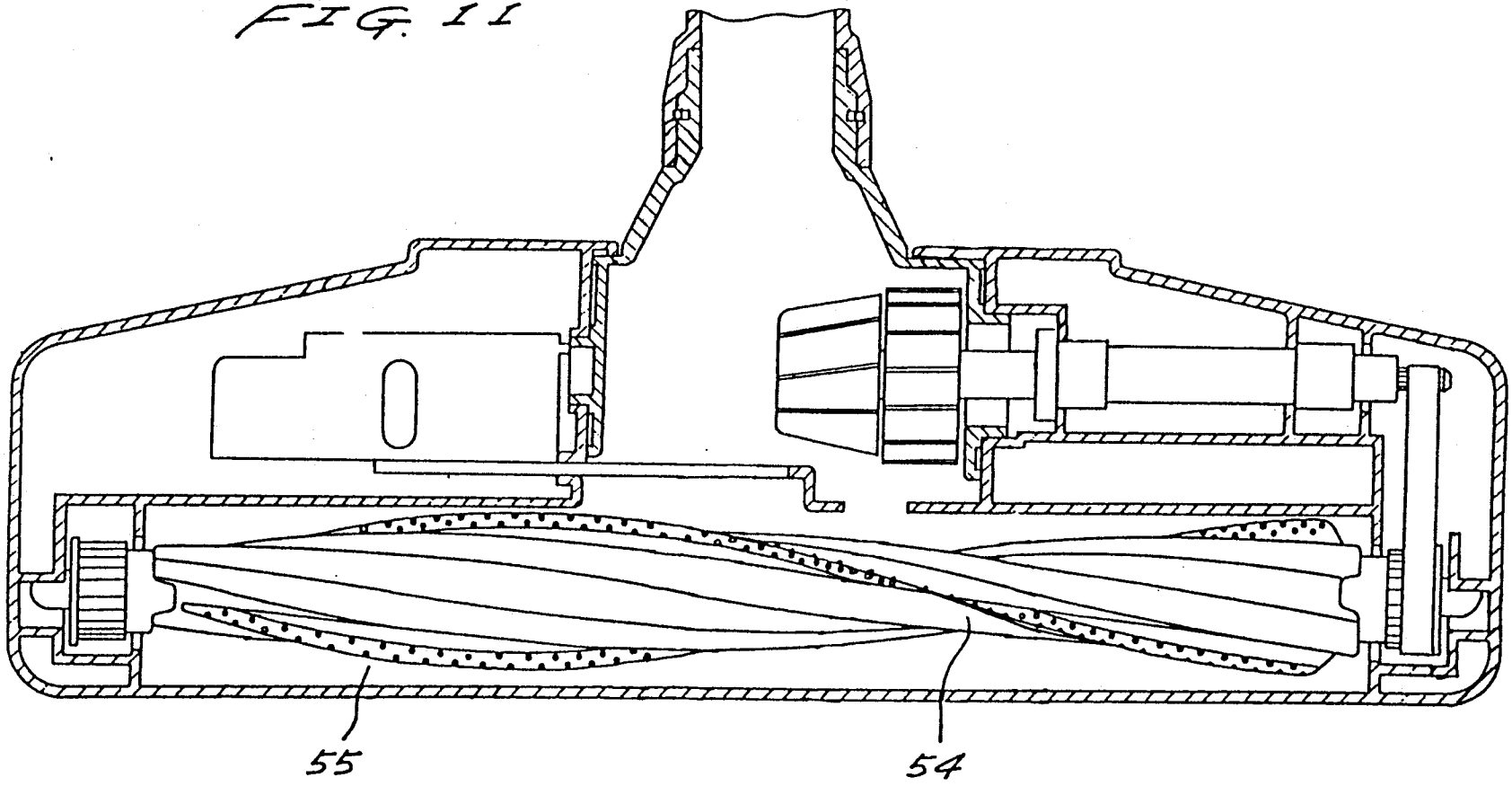
FIG. 11 is a sectional plan view of a floor nozzle according to another embodiment of the present invention, with an upper casing omitted from illustration.
Figure 12:
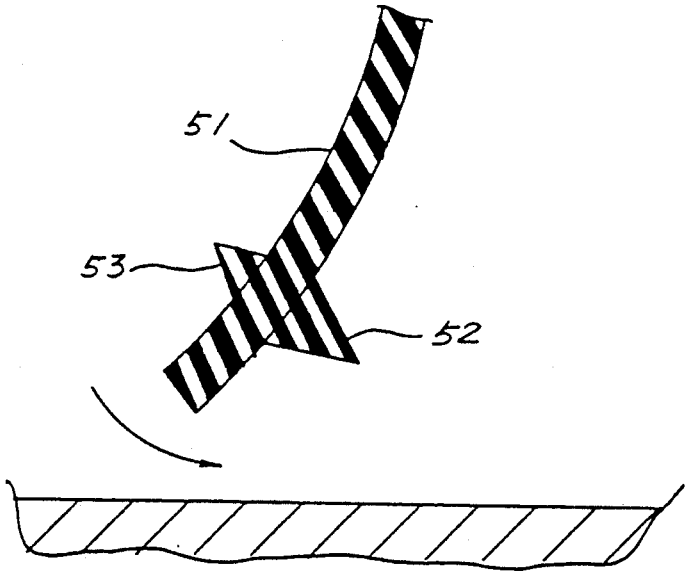
FIG. 12 is a fragmentary transverse cross-sectional view of an agitator according to a further embodiment of the present invention.

According to still another embodiment shown in FIGS. 11 and 12, each elongate web 51 of an agitator 54 is made of a flexible material such as rubber or the like, and has a multiplicity of conical teeth 52, 53 on its opposite surfaces, the teeth 52 being higher than the teeth 53. For cleaning a carpet having a relatively long pile, the agitator 54 in a suction chamber 55 is rotated counterclockwise (FIG. 12) to cause the higher teeth 52 to brush up waste threads, hairs, and the like from deep within the carpet tuft. When a carpet having a relative short pile is to be cleaned, the agitator 54 is taken out, turned around, and then put back into the suction chamber 55 to cause the lower teeth 53 to brush up waste threads, hairs, and other filamentary objects from the carpet without damaging the carpet surface. By thus selectively employing the opposite surfaces of the web 51, unwanted threads, hairs, and filamentary dust pieces can be removed from various kinds of carpets or rugs, and the agitator 54 can have a service life which is almost twice the service life of conventional unidirectional agitators.

Figure 13:
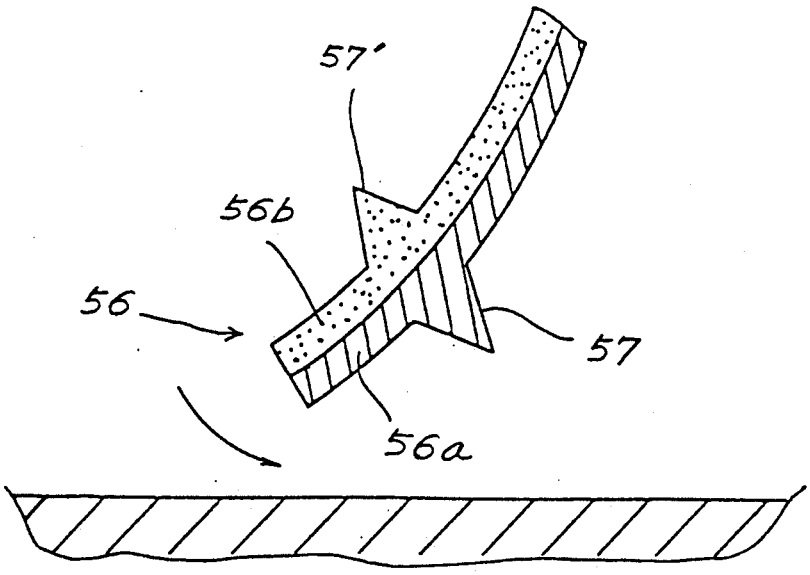
FIG. 13 is a fragmentary transverse cross-sectional view of an agitator according to a still further embodiment of the present invention.

FIG. 13 illustrates yet another embodiment in which an elongate web 56 comprises a web member **56*a* having teeth 57 made of a harder material and a web member 56*b* having teeth 57' made of a softer material, the web members 56*a*, 56*b* being joined back-to-back to each other. For cleaning a carpet having a relatively long pile, the agitator is rotated counterclockwise (FIG. 13) to cause the harder teeth 57 to catch entangled waste threads, hairs, and the like from the carpet tuft. When a carpet having a relatively short pile is to be cleaned, the agitator is taken out, turned around, and then put back into the suction chamber to cause the softer teeth 57' to brush up waste threads, hairs, and other filamentary objects from the carpet without damaging the carpet surface. By thus selectively employing the harder and softer teeth 57, 57', unwanted threads, hairs, and filamentary dust pieces can be removed from various kinds of carpets or rugs, and the web 56** is rendered durable and can have a service life which is almost twice the service life of conventional unidirectional webs.

Figure 14:
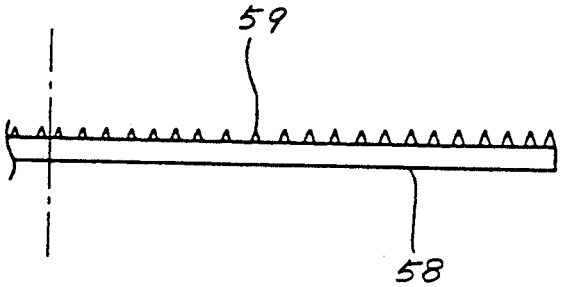
FIG. 14 is a fragmentary side elevational view of an elongate web according to another embodiment of the present invention.

FIG. 14 shows an elongate web 58 in accordance with a further embodiment of the present invention. The web 58 has a plurality of teeth 59 with their height progressively lower toward the center of the web 58 and progressively higher toward the opposite ends of the web 58. The teeth 59 which are higher at the opposite ends of the web 58 are effective in separating hairs and waste threads reliably from a floor surface at areas below the opposite ends of the floor nozzle where the vacuum suction is relatively weak. This permits corners of the floor surface being cleaned to be cleaned more effectively by the ends of the floor nozzle.

If all the teeth 59 were of increased height, they would present greater frictional resistance to their movement on the floor surface, resulting in a reduction in the rotational speed of the agitator and hence in a reduction in the dust-collecting capability of the floor nozzle. According to the embodiment shown in FIG.

14, however, since the teeth 59 are lower in the central area of the web 58 and higher in the opposite end areas of the web 58, the frictional resistance to which the web 58 is subjected as a whole while cleaning the floor nozzle remains the same as would be with teeth of equally moderate height. Consequently, a desired dust-collecting capability is maintained without lowering the speed of rotation of the agitator.

Figure 15:
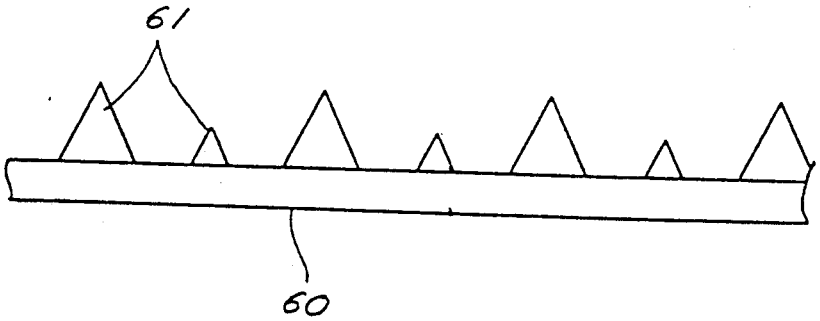
FIG. 15 is a fragmentary side elevational view of an elongate web according to still another embodiment of the present invention.

FIG. 15 illustrates a still further embodiment of the present invention. In this embodiment, an elongate web 60 has a plurality of alternately arranged higher and lower conical teeth 61. Since the teeth 61 have alternately different heights, even if the tip ends of the higher teeth 61 are worn and rounded, the lower teeth 61 are still effective to remove thread pieces and hairs from a floor surface being cleaned. Accordingly, a desired dust-collecting capability is maintained over a long period of time.

Figure 16:
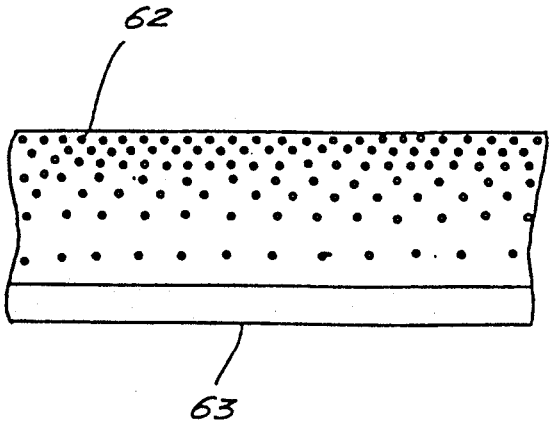
FIG. 16 is a fragmentary side elevational view of an elongate web according to yet still another embodiment of the present invention.

According to a yet further embodiment shown in FIG. 16, teeth 62 on an elongate web 63 are progressively denser toward the distal edge of the web 63 and progressively further spaced apart toward the proximal edge of the web 63. Because the density of the teeth 62 is progressively less toward the proximal edge of the web 63, the web 63 is lower in stiffness at the proximal edge and hence can be flexed to rub a floor surface to be cleaned, enabling the denser teeth 62 near the distal edge of the web 63 to catch and collect filamentary dust pieces and hairs with an improved dustcollecting capability. Moreover, since the frictional resistance between the distal edge of the web 63 and the floor surface being cleaned is large, when the web 63 recovers from the flexed condition under its own resiliency and centrifugal forces at the instant the distal edge of the web 63 is released from the floor surface, the web 63 springs back strongly to collect unwanted hairs and waste threads more effectively.

With the present invention, as described above in detail, filamentary dust pieces such as waste threads and hairs are effectively collected by and prevented from entanglement with the agitator on various different floor surfaces in houses, and at the same time the floor nozzle can maintain a desired high dust-collecting capability over a long period of time. The agitator can also be assembled with ease and is of high quality.

Although certain preferred embodiments have been shown and described, it should be understood that many changes and modifications may be made therein without departing from the scope of the appended claims.

What is claimed is:

1. A floor nozzle for use with a vacuum cleaner, comprising:

a housing;

an agitator rotatably and detachably disposed in said housing, said agitator including:

a rotor;

at least one elongate web mounted on a circumferential surface of said rotor, said elongate web including:

a first member having a plurality of first teeth made only of a first material;

a second member having a plurality of second teeth made only of a second material that is softer than said first material;

wherein said first and second members are joined back-to-back to each other with said first and second teeth being directed away from each other; and means disposed in said housing for rotating said agitator;

whereas the harder teeth catch debris from a long pile carpet; and further wherein placing the softer teeth in the direction of rotation said softer teeth brush debris from a relatively short pile carpet.

* * * * *